United States Patent [19]

Munn et al.

[11] 3,979,112

[45] Sept. 7, 1976

[54] SHEET STACKING AND INTERLEAVING APPARATUS

[75] Inventors: Robert Munn, Garnerville; Albert Tiso, Eastchester, both of N.Y.

[73] Assignee: George Hantscho Company, Inc., Mount Vernon, N.Y.

[22] Filed: Feb. 6, 1975

[21] Appl. No.: 547,508

[52] U.S. Cl. ..... 270/58; 93/93 D; 270/59

[51] Int. Cl.[2] ..... B65H 39/055

[58] Field of Search ..... 270/58, 59; 93/93 D; 271/142

[56] References Cited

UNITED STATES PATENTS

| | | | |
|---|---|---|---|
| 1,709,004 | 4/1929 | Broadmeyer | 270/58 |
| 2,122,710 | 7/1938 | Bidwell | 93/93 D |
| 2,255,777 | 9/1941 | Jones | 270/58 |
| 2,384,768 | 9/1945 | Rau | 270/58 |
| 2,937,019 | 5/1960 | Rose | 271/142 |
| 3,216,719 | 11/1965 | Flora | 270/58 |

*Primary Examiner*—Edgar S. Burr
*Assistant Examiner*—A. Heinz
*Attorney, Agent, or Firm*—Eugene E. Geoffrey, Jr.

[57] ABSTRACT

Apparatus for stacking pre-cut sheets and interleaving heavier pieces of material to form backs and or covers for groups of sheets wherein said sheets are transported through a path for deposition on a stack. At the same time cards and/or covers are fed into a second path intersecting the first path and means are provided in the second path for periodically advancing the cards or sets of cards and covers so that a card or a card and cover will be fed into the first path between successive groups of sheets and deposited on the stack.

7 Claims, 17 Drawing Figures

SHEET STACKING AND INTERLEAVING APPARATUS

Figure 1:
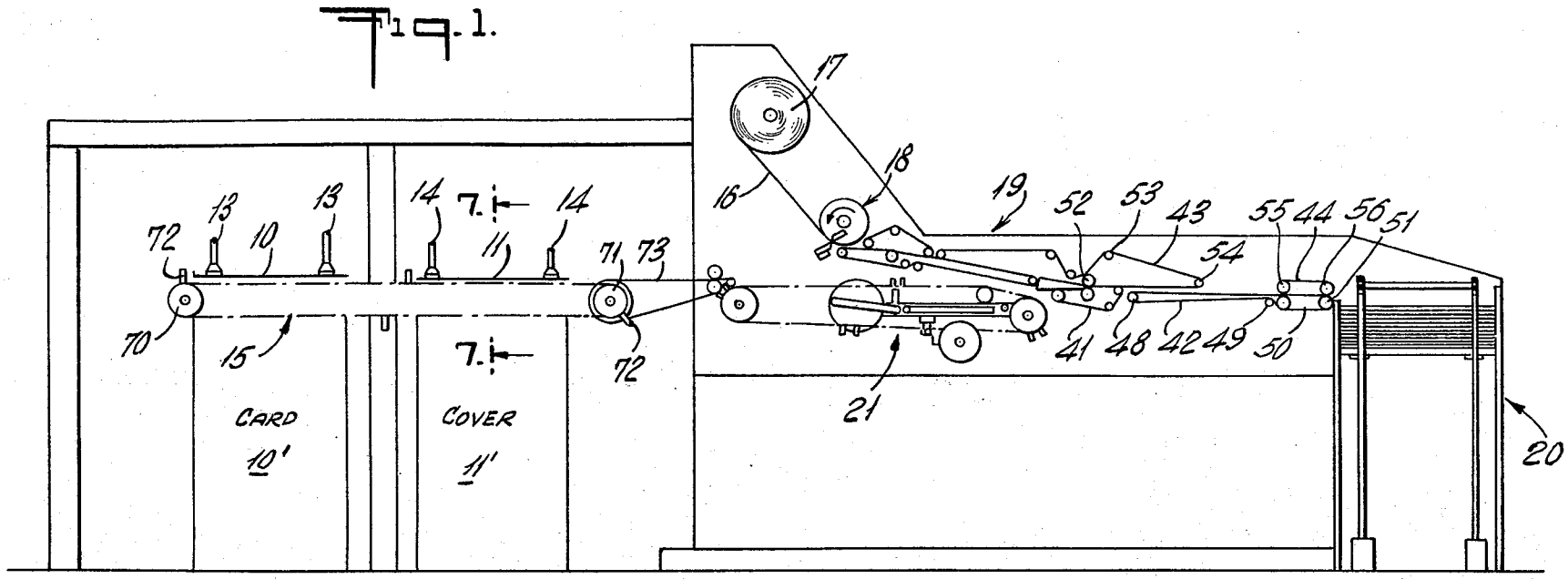

This invention relates to sheet stacking means generally adapted for use with printing presses and more specifically to a novel and improved sheet stacker including means for insertion of cards and covers between groups of sheets to form covers and backs for pads.

While a wide variety of stacking devices have been suggested for printing presses, including means for feeding sheets of material from at least two sources to a common stack such devices have not been found satisfactory for handling relatively thin sheets and relatively heavy cards and at the same time insure accurate alignment thereof prior to feeding them to the stacker. This invention has as one of its objects means for selectively controlling the feeding means for sheets and cards of different thicknesses so that any desired arrangement of the sheets can be obtained.

Another object of the invention resides in the provision of a novel and improved feeding and stacking device capable of feeding cards and/or covers onto a stack at intervals while feeding a plurality of sheets during each interval with the cards and/or covers serving as the backs and/or fronts of pads or other similar articles.

Still another object of the invention resides in the provision of novel and improved apparatus for stacking sheets with a card and/or cover interleaved between selected numbers of sheets to form pads or booklets with either a card for the back to impart stiffness or with the card on the back and a cover on the front.

These ends are attained by a novel and improved procedure for feeding sucessive sheets onto a stack and then feeding either a card or a card and a cover onto the stack and in synchronism with a sheet. When a card and a cover are to be fed onto the stack they are first placed in overlying relationship and then are fed simultaneously onto the stack. In this way the cards, covers and sheets are always maintained in precise registry.

The above and other objects and advantages of the invention will become more evident from the following description and accompanying drawings forming part of this application.

In the Drawings:

FIG. 1 is a side elevational view in partially diagrammatic form of one embodiment of the invention.

Figure 2:
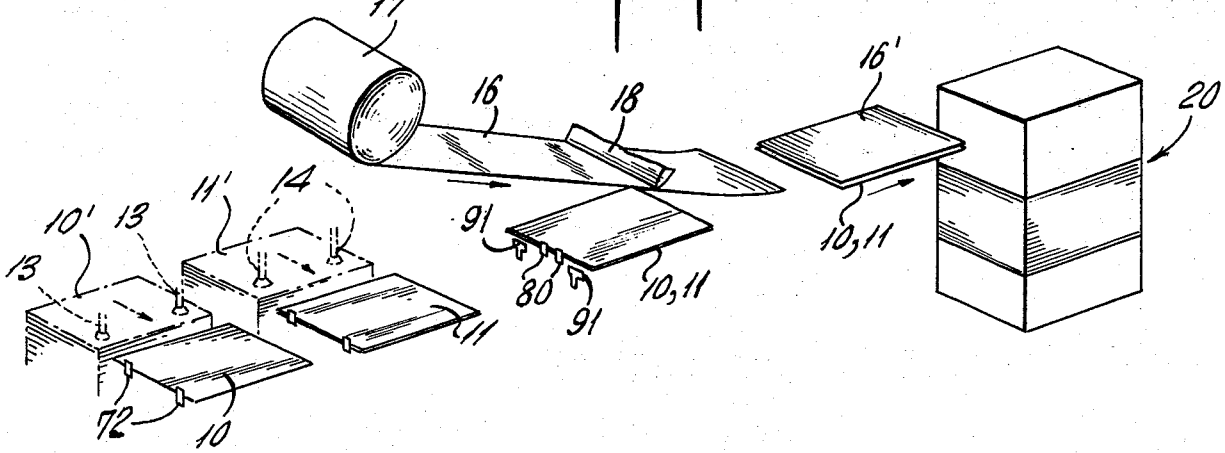
Figure 3:
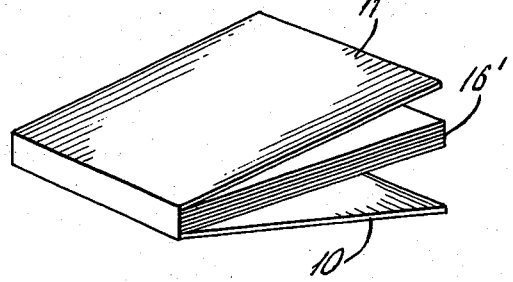
Figures 4, 5, 6:
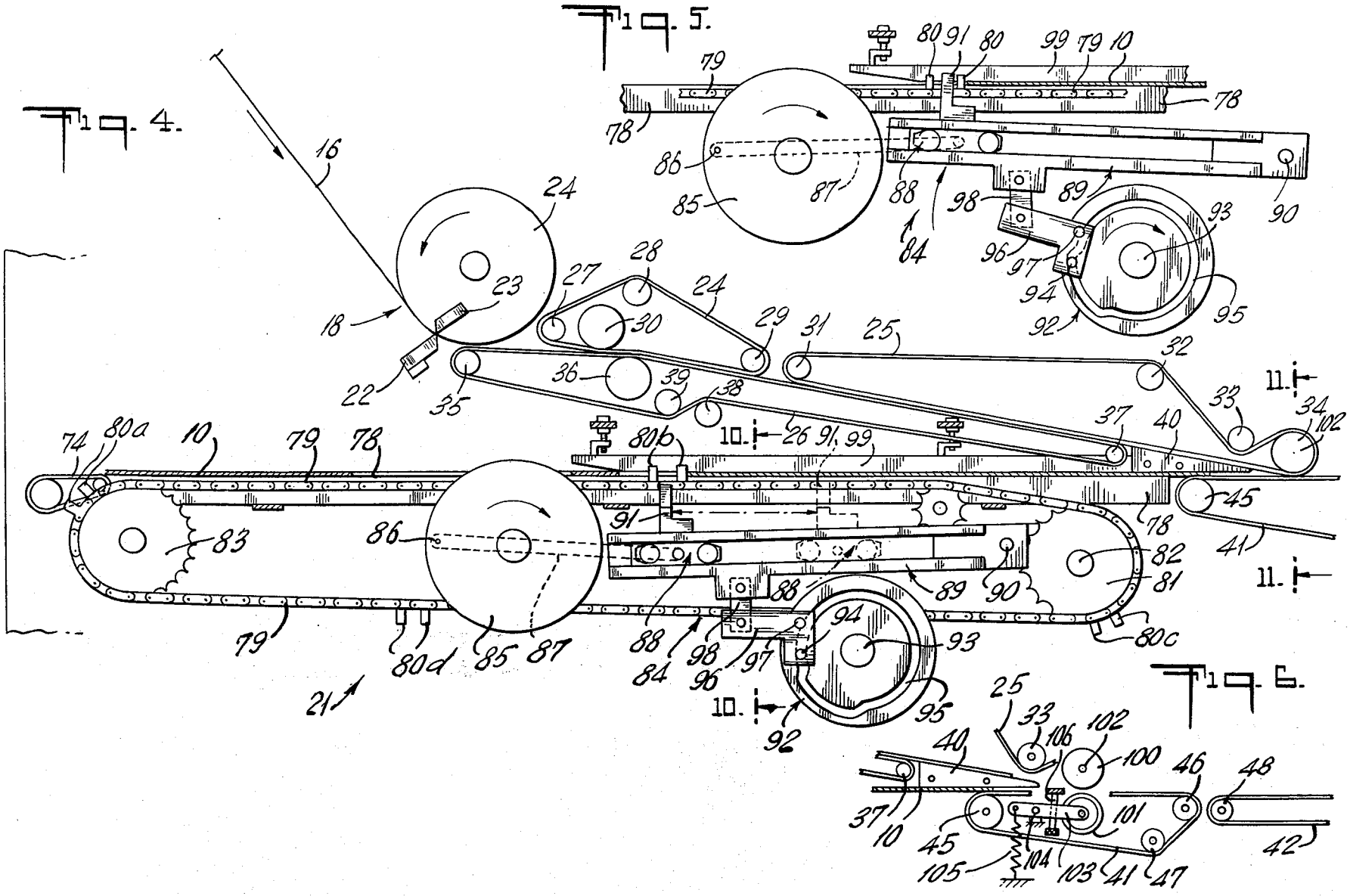

FIG. 2 is a diagrammatic view in perspective of the embodiment of the invention shown in FIG. 1, FIG. 3 is a perspective view of a pad produced by apparatus in accordance with the invention, FIG. 4 is a side elevational view in partial section of the card and cover transporting and insertion mechanism, in the disengaged position, FIG. 5 is a fragmentary view of FIG. 4 with the insertion mechanism in position for inserting a card and cover, FIG. 6 is a fragmentary view in partial section of a portion of the card and cover insertion mechanism.

Figures 7, 8, 9:
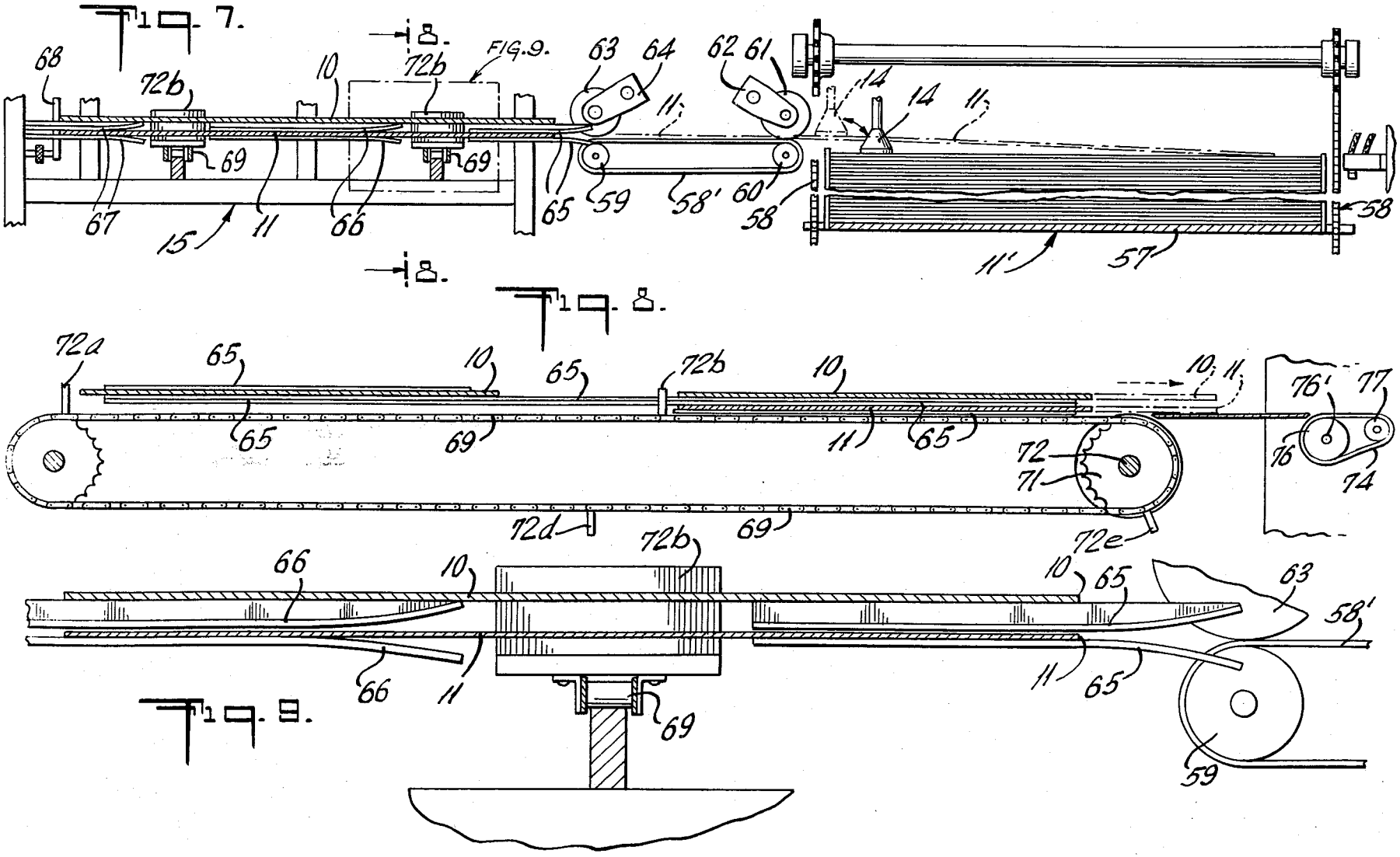
Figure 10:
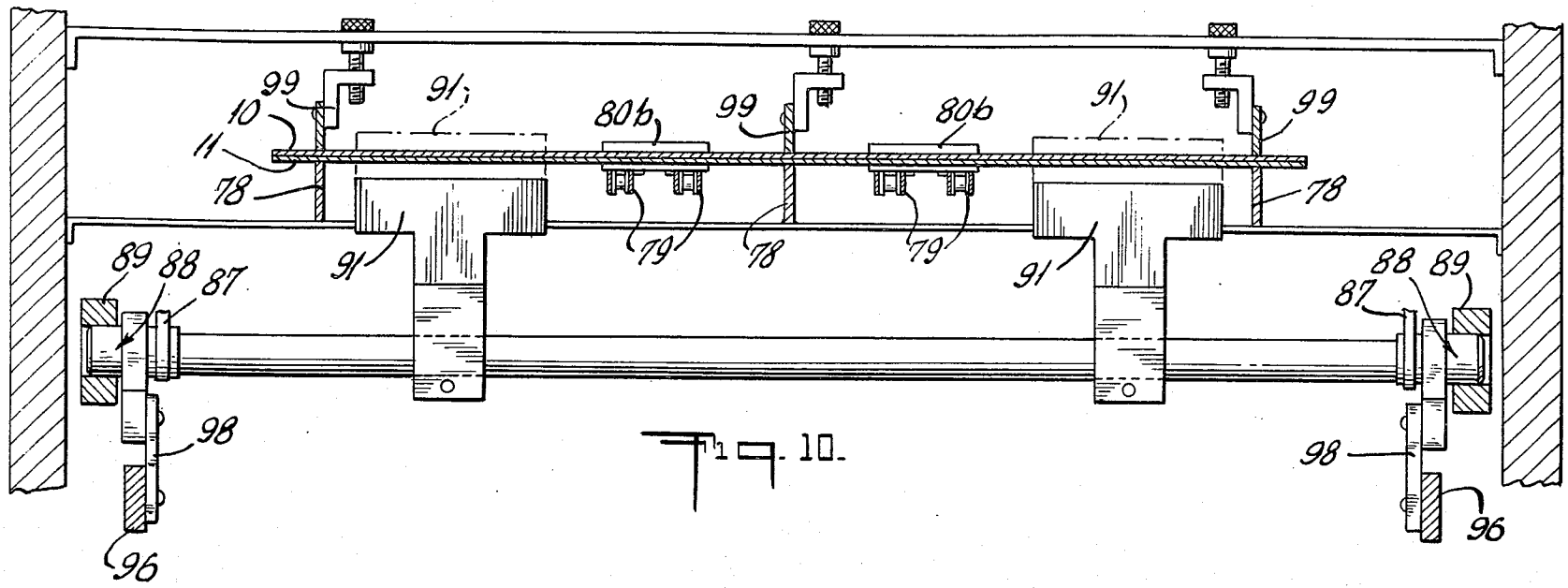
Figure 11:
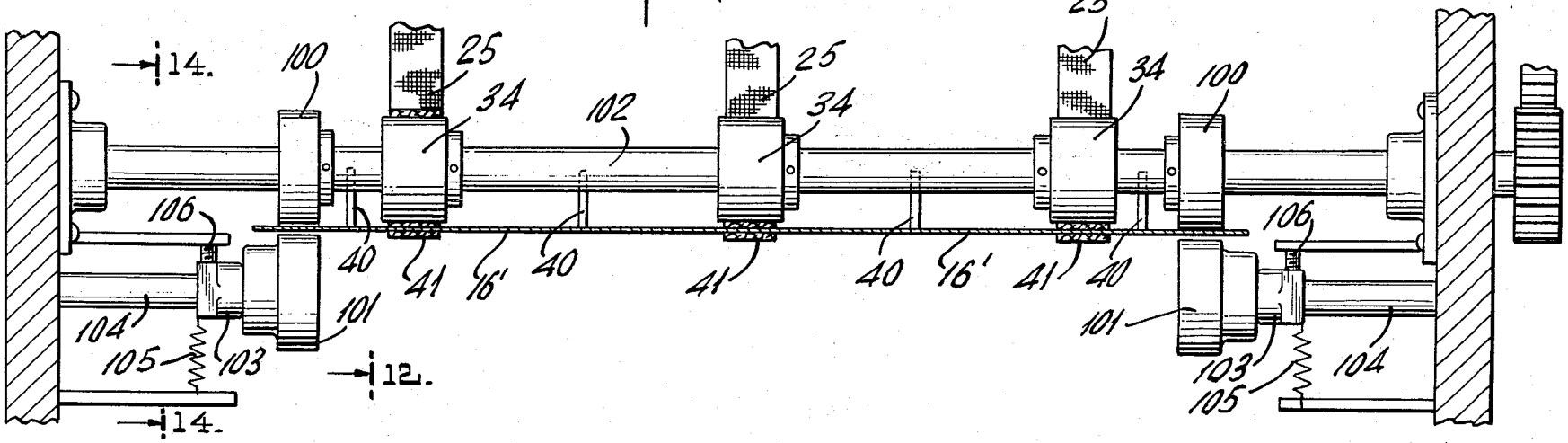
Figures 12, 13, 14, 15:
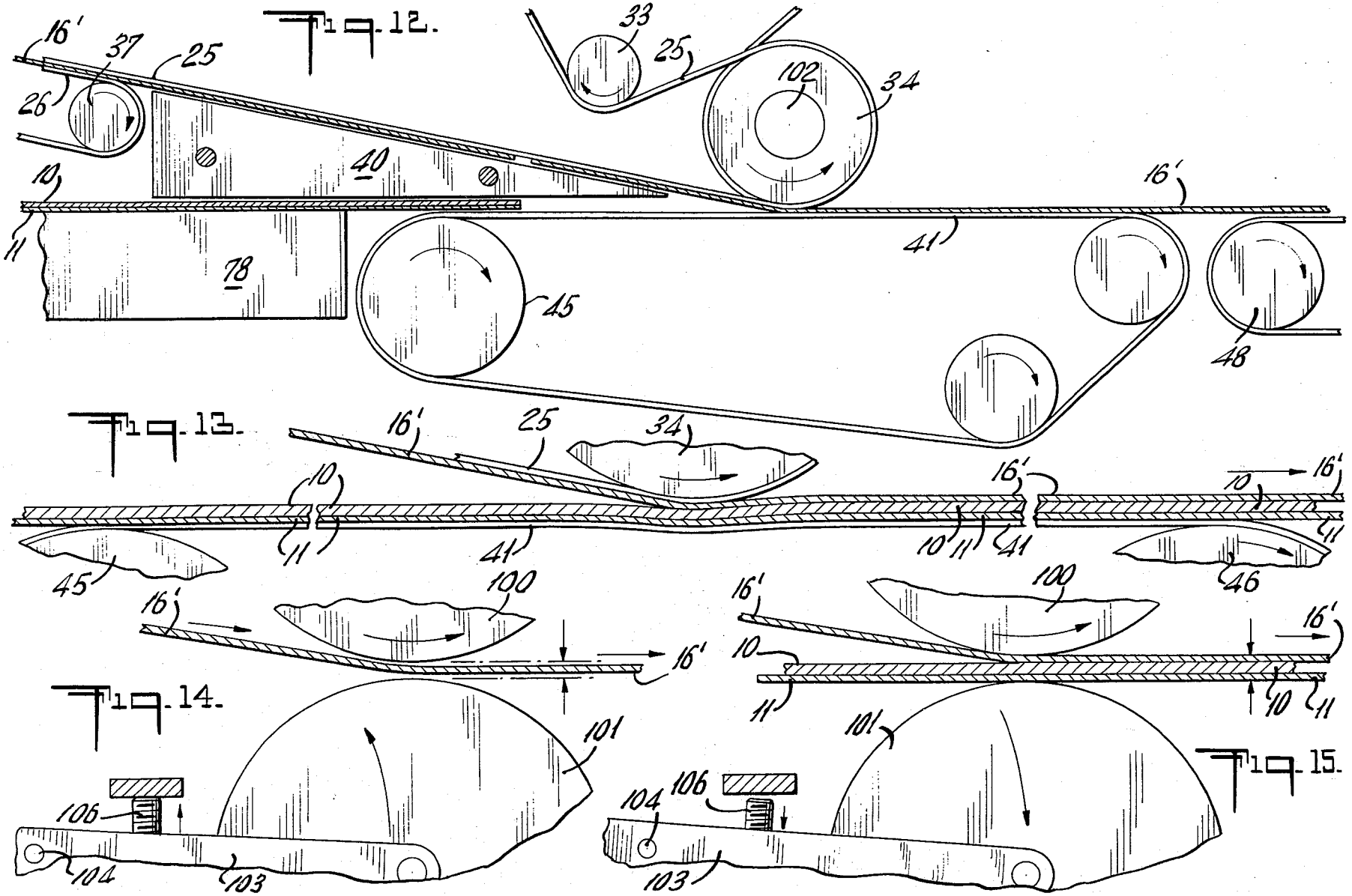
Figures 16, 17:
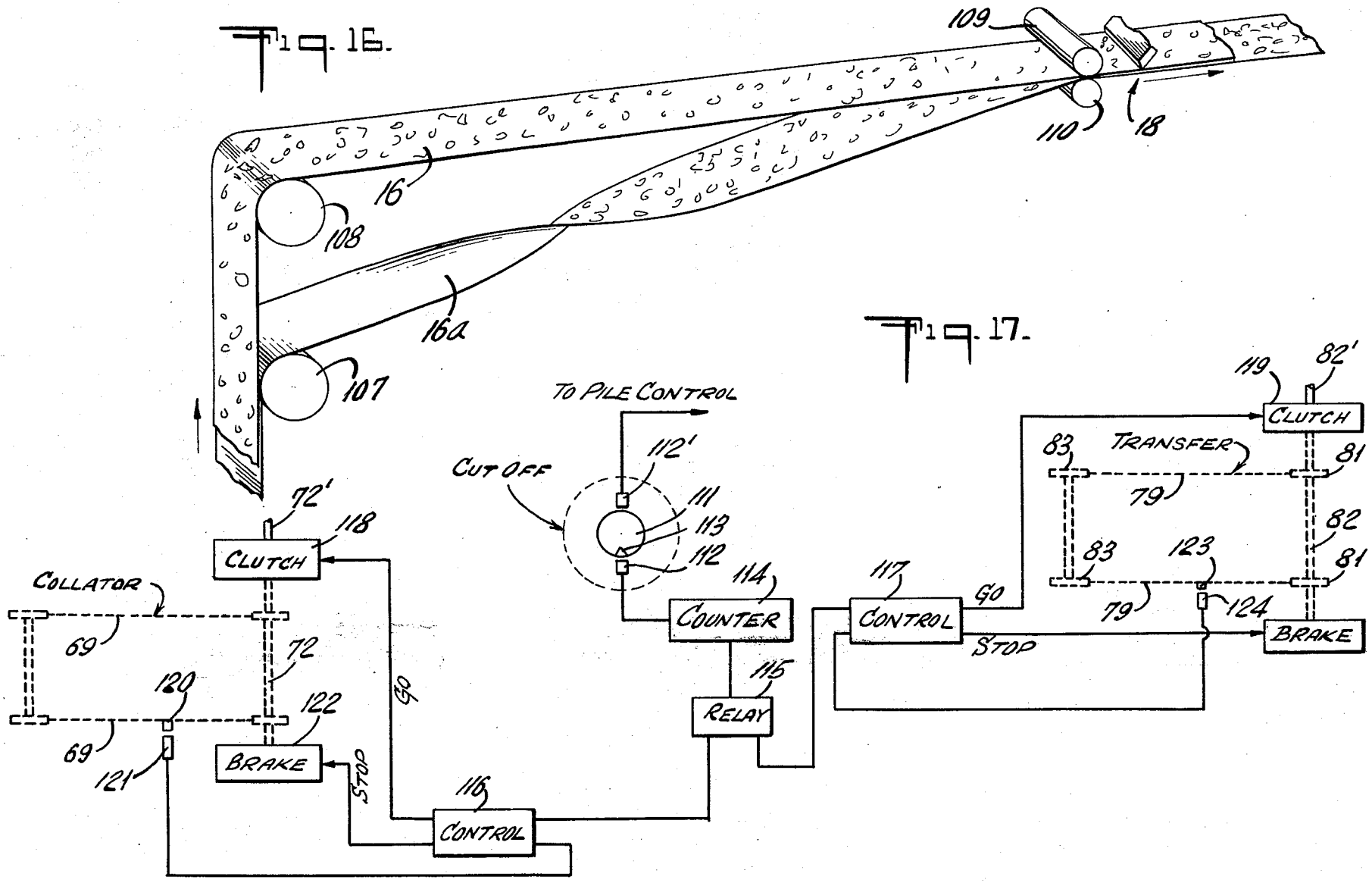

FIG. 7 is a cross sectional view of apparatus for transporting covers (cards) from a stack to the transporting mechanism for interleaving them with the sheets, FIG. 8 is a cross sectional view of FIG. 7 taken along the line 8—8 thereof, FIG. 9 is an enlarged view of the portion of FIG. 7 outlined in broken lines, FIG. 10 is a cross sectional view of FIG. 4 taken along the line 10—10 thereof, FIG. 11 is a cross sectional view of FIG. 4 taken along the line 11—11 thereof, FIG. 12 is a cross sectional view of FIG. 11 taken along the line 12—12 thereof, FIG. 13 is an enlarged view of a fragmentary part of FIG. 12 showing the feeding means for the sheets, cards, and covers, FIG. 14 is a cross sectional view of FIG. 11 taken along the line 14—14 thereof, FIG. 15 is a cross sectional view similar to FIG. 14 showing the displacement of a feed roller to accept a sheet, card and cover, FIG. 16 is a diagrammatic perspective view of a dual sheet feeding means for use with apparatus in accordance with the invention, and FIG. 17 is a block diagram of the electrical and mechanical controls for controlling the operation of the apparatus shown in FIGS. 1 to 15.

Referring now to the drawings and more specifically to FIGS. 1 and 2, cards or cards and covers 10 and 11 are fed from stacking means 10' and 11' by means of suction cups 13 and 14 onto suitable conveying means 15. A pre-printed web 16 is fed either from a roll 17 or from a printing press to a cutting station 18 and the severed sheets 16' are then transported by a series of belts generally denoted by the numeral 19 to the stack 20. An insertion mechanism 21 feeds a card or a card and cover in aligned overlying relationship periodically into the stream of severed sheets and then onto the stack 20. The periodicity is determined by the number of sheets required for the finished pad or book as the case may be. Upon binding the sheets with the cards and covers, the individual pads or books may be separated to produce the structure as shown in FIG. 3 which includes a card on the back thereof to provide stiffness and a thin flexible cover. It is to be understood, of course, that the pad shown in FIG. 3 may be provided only with the relatively stiff backing card 10.

The apparatus for cutting the web 16 and feeding the severed sheets 16' is generally shown in FIG. 1, 4 and 11 through 15, The web 16 is fed either from a roll 17 or directly from a printing press to the cutting station 18 of conventional construction and having a fixed cutting blade 22 and a rotating cutting blade 23 carried by the cylinder 24. The severed sheets are then carried by belt conveyors 24, 25 and 26 each comprising a plurality of narrow belts with the belts 24 carried by rollers 27 to 30, the belts 25 carried by rollers 31 to 34 and the belts 26 carried by rollers 35 to 39. Each sheet 16' upon leaving belts 26 move between a triangular guide 40 and the forward ends of belts 25 whereupon they are carried by sets of belts 41, 42, 43, 44 and 50 (see FIG. 1) the belts 42, 44 and 50 operating at a slower speed and deposited on the stack 20. The belts 41 are supported by rollers 45 through 47, the belts 42 by rollers 48 through 51, the belts 43 by rollers 52 through 54 and the belts 44 by rollers 55 and 56.

With the invention as thus far described severed sheets 16' are delivered successively and in overlapping relationship to the stack 20. The apparatus for interleaving the cards 10 and covers 11 with the sheets 16' will now be described. This apparatus is shown in detail in FIGS. 4 through 15.

In the operation of the apparatus cards or cards and covers are always placed in position by the mechanism 21 to be immediately interleaved between selected sheets. To effect this end cards and covers are periodically transported from the stacks 10' and 11' to the conveyor 15 as shown in FIG. 1. Since the apparatus for handling both cards and covers are similar only the cover transporting means will be described. As will be observed in FIGS 7, 8 and 9 covers 11 are carried by stacking means 11' having a base plate 57 supported by automatic elevating means 58 to maintain the top cover 11 in contact with suction cups 14. To move a cover 11 from the stack, suitable means not shown function to lift the cups 14 and displace them to the left as shown in FIG. 7 so that the leading edge of a cover engages the belts 58' carried by rollers 59 and 60 and the cooperating roller 61 carried by a support 62. A second roller 63 carried by a support 64 cooperates with the belt and feeds the cover 11 between sets of guides 65, 66 and 67 which are spaced one from the others. The cards 10 are also transferred in a like manner to similar sets of guides aligned with the cover guides but spaced upwardly therefrom. This will be observed more clearly in FIG. 8. The longitudinal alignment of the covers and cards is effected by a guide 68 as shown in FIG. 7.

As will be observed in FIGS. 1, 2 and 8, initial transportation of the cards and covers for collation is effected by chains 69 carried by sprockets 70 and 71 with the sprocket 71 being driven periodically by the shaft 72. The chains 69 carry fingers or dogs 72*a*, *b*, *c*, and *d* and each time the chains 69 are operated they move the dogs a distance equal to the distance between successive dogs. Thus when cards and covers are both used they are fed simultaneously to positions against the stop or longitudinal guide 68. Upon operation of the chains 69, a card 10 is moved by the dog 72*a* to the cover station so that it will overlie the next cover to be transported from the stack 11' to a position overlying the chains 69. At the same time the dog 72*b* moves the previously collated card and cover onto belts 74 with the belts 74 being carried by pulleys or rollers 76 driven by the shaft 76' and a second set of rollers 77. The belts 74 move each set of collated cards and covers to a position where the trailing edges thereof are just beyond the right ends of the belts 74. Thus cards or cards and covers are periodically displaced forwardly for engagement and stacking with the sheets 16' .

Referring again to FIG. 4, the collated card and cover or card alone, as the case may be, has been deposited on longitudinal supports 78 for further forward movement by chains 79 carrying sets of dogs 80*a* to 80*d* with the trailing dog of each set being permanently magnetized for control purposes as will be described. It will also be observed that a card 10 is positioned forwardly of the leading dog 80*b* perparatory to being moved into aligned engagement with a sheet 16'. Movement of the chains 79 is effected by the driven sprocket 81 carried by shaft 82. This arrangement places each successive card or card and cover in position for advancement into the sheet stream with the leading edge thereof coinciding with the leading edge of sheet 16'.

The apparatus 84 includes a rotary member 85 timed precisely with the cutter roller 24. A rod 87 has one end pivoted at 86 to the rotary member 85 and its free end connected to a slide or trolley 88 riding within the track 89 the latter being pivoted at 90 to the frame of the apparatus. The trolly 88 carries an upwardly extending dog 91 which when in the retracted solid line position is aligned with the space between the dogs 80*b* as illustrated in FIG. 4. The dog 91 is normally and continuously reciprocated between the solid and broken line positions thereof, and the track 89 is normally in the lower position as illustrated. With this arrangement the dog 91 rides in a lower position to permit the cards or combinations of cards and covers to pass thereover and permit the dog to engage the trailing edge thereof. The dog 91 upon being raised moves the card or card and cover into the sheet stream and the forward motion of the dog 91 is always synchronized with the forward displacement of the sheets 16'.

To effect transport of a card or card and cover, a cam 92 carried by shaft 93 is driven through one revolution and the cam follower 94 riding in the groove 95 pivots the bell crank 96 about its pivot 97. The left end of the bell crank 96 is coupled to the track 89 by a link 98 which thus raises the track and moves the dog 91 into engagement with the trailing edge of the card 10 and move it into engagement with the belt 41 and in alignment with a sheet 16'. Power is applied to rotate the shaft 72 and 82 when it is necessary to transport the next card or card and cover into position for engagement by the dog 91. When the pusher dog 91 reaches the end of its throw and prior to retraction, the cam 92 automatically lowers the pusher dog to permit the next card or card and cover to be moved thereover.

The transport of a card or card and cover and engagement with the severed sheets is shown in FIGS. 6 and 11 through 15. Assuming that both a card and cover are being processed, guides 99 (FIGS. 4 and 10) would have been preadjusted to compensate for their combined thickness and the dogs 91 would have moved the collated card and cover into engagement with belts 25 and 41 to transport them in synchronism with a sheet 16'. At the same time the card 10, cover 11 and a sheet 16' are engaged by sets of rollers 100 and 101 with the rollers 100 being carried by the driven shaft 102 which also carried the rollers 34 (FIG. 11). The rollers 101 are each carried by a link 103 pivotally carried by shaft 104. The links 103 are each biased by a spring 105 to move its associated roller upwardly against an adjustable stop 106. It will be observed in FIG. 11 that the rollers 100 and 101 are adjusted so that they do not engage the sheets 16 but will engage a card and a sheet or a card and cover and a sheet as will be observed in FIGS. 13 and 15.

Referring to FIG. 12, the relative positions of a sheet 16' and a card and cover will be observed. At this step in the process the card and cover are being moved by the dogs 91 until they engage the belts 25 and 41 and simultaneously engage the sets of rollers 100 and 101. It will be observed in FIG. 13 that the belt 41 is deflected downwardly by the card and cover and at the same time the rollers 101 are deflected downwardly from the normal position shown in FIG. 14 to the position shown in FIG. 15. In this way a positive drive is provided for the card, cover and sheet whereupon they are then carried in alignment by belts 42 and 44 for disposition on the stack (FIG.1).

It was previously pointed out in connection with FIG. 1 that the printed or unprinted web 16 may be supplied from a roll 17 or directly from a printing press. In certain cases dual webs 16 and 16*a* (FIG. 16) may be simultaneously printed by a press in which case the web 16*a* after passing over roller 107 is reversed while the web 16 is maintained in normal orientation upon leaving roller 108. In this way the printed sides of the web are now in the same direction and pass betweem rollers 109 and 110 to the cutting station 18. This procedure increases the speed of the process since for a pad of a given number of pages, the time required to deliver them to the stack is reduced to one half and cards or cards and covers can then be delivered at twice the rate.

A block diagram illustrating the control means for the apparatus previously described is shown in FIG. 17. While it will become apparent that pads or books with any number of sheets may be assembled with this invention let it be assumed that a card and cover is to be inserted between each 50 sheets on the stack 20. The basic control for operation of the apparatus is effected by the cut off roller 24 for this purpose the cut off cylinder 24 includes a cylindrical member 111 having a pair of photoelectric sensors 112 and 112' associated therewith and sensor activating element 113. The sensor 112' is pulsed by the activating element 113 once for each revolution and in turn controls the level of the stack 20 in a conventional manner. The sensor 112 is also activated once for each revolution and feeds its pulses to the counter 114. If single sheets 16' are handled then the counter is set to produce an output pulse after receiving a number of input pulses equivalent to the number of sheets to be included between each card or card and cover. should a double web be used then the counter would be programmed to produce an output pulse upon receipt of a number of input pulses equal to one half the number of sheets. When the counter 114 receives the selected number of pulses the output pulse is fed to the relay 115 whereupon the counter automatically resets itself to continue to the next count. Actuation of the relay 115 sends pulses to controls 116 and 117. Control 116 activates an electrically operated clutch 118 coupling a driven shaft 72' with the shaft 72 to actuate the collator 15. At the same time control 117 activates an electrically operated clutch 119 to couple the driven shaft 82' to the shaft 82 which drives the chain 79 and dogs 80*a* to *d* to feed a card and cover to a position wherein the trailing edge can be engaged by dog 91.

The operation of the dog 91 was previously discussed and since its forward velocity should be effectively equal to the velocity of the sheets 16' and therefore the peripheral velocity of the cut off cylinder 24, wheel 85 which is mechanically coupled to the cylinder 24 will be rotated constantly at a predetermined speed relative to the cut off cylinder 24. Rotation of the cam 92, which is synchronized with the rotation of cylinder 24, raises the dog 91 to advance the card and cover for movement with a sheet 16' to the stack 20 and retracts of the dog 91. Each time a card and cover are moved to a position over dog 91 for delivery to the stack, cards and covers are delivered from stacks 10' and 11' to the collator 15, previously delivered cards and covers are collated, previously collated cards and covers are moved forwardly to assume the position just to the rear of dogs 80*b* carried by chains 79 as shown in FIG. 4 and the card and cover previously positioned to the rear of dogs 80*b* are displaced forwardly preparatory to being fed to the stack 20.

After the control 116 has been activated to engage the clutch 118, the operation continues until one of four equally spaced magnets 120, of which only one is shown, activates the magnetic sensor 121 and cause the control to disengage clutch 118 and activate the brake to immediately terminate rotation of the shaft 72. Similarly the rotation of transfer chains 79 by shaft 82 is terminated when one of four equally spaced magnets 123 carried by one of the chains 79, of which only one magnet is shown, passes the magnetic sensor 124. The sensor delivers a pulse to the control 117 causing it to disengage clutch 119 and actuate the brake to stop rotation of shaft 82. It is to be understood that when the controls 116 and 117 are actuated by relay 115, the associated brakes are released and the clutches engaged while when the controls are actuated by the sensor, the reverse operation occurs.

while only one embodiment of the invention has been illustrated and described it is understood that alterations, changes and modifications may be made without departing from the true scope and spirit of the invention as defined by the appended claims.

What is claimed is:

1. Apparatus for stacking sheets of paper and similar material interleaved with pieces of material of equivalent area but increased thickness to form pads and other similar articles comprising means for feeding successive sheets along a predetermined path and onto a stack, means for counting successive sheets, loading means for feeding successive pieces of material periodically from a supply location into a second path aligned with and spaced from the first said path, said paths intersecting at a point spaced from said stack, means for periodically transporting said successive pieces of material along said second path to a position spaced from said supply location and adjoining said intersecting point, said transporting means also being periodically actuated by said counting means for propelling a leading piece of material in said second path adjoining said intersecting point through said intersecting point at the precise speed of movement of and in alignment with one of said sheets entering said intersecting point from said first path for deposition onto said stack and simultaneously advancing a successive piece of material into said position and feeding another piece of material into said second path, said counting means functioning to actuate said transporting and loading means each time a predetermined number of sheets have passed said point of intersection, a cutting station having cutting means, means for feeding a web to said cutting station to cut said web into said sheets, means carried by said cutting means and coupled with said counter for counting said sheets, said counter being operable upon the attainment of a predetermined count to actuate said transporting and loading means and to automatically reset and start the next successive count.

2. Apparatus according to claim 1 wherein said transporting means comprises a first transporting section including conveying means carrying a plurality of sets of dogs and a second transporting section having conveying means carrying a plurality of sets of dogs, and said cutting means comprises a rotary cutter, synchronized means for driving said cutter and said transporting sections, a clutch coupling of said transporting sections to said synchronized driving means and a brake to stop operation of each transporting section upon disengagement of the clutch, said counter being operable to effective engagement of said clutches upon completion of a predetermined count and means carried by each of said transporting sections for disengaging the associated clutch and applying said brake to precisely control the foward transport of said pieces of material.

3. Apparatus according to claim 2 including a reciprocating element synchronized with said rotary cutter and having a linear speed substantially equal to the forward speed of said sheets, a pusher dog carried by said reciprocating element and means actuated by said counter for moving said dog into engagement with the trailing edge of the leading piece of material to move it into said first path, and means including pressure rollers for gripping said piece of material and transporting it with a sheet to said stack.

4. Apparatus for stacking sheets of paper and similar material interleaved with pieces of material of equivalent area but increased thickness to form pads and other similar articles comprising means for feeding successive sheets along a predetermined path and onto a stack, means for counting successive sheets, loading means for feeding successive pieces of material periodically into a second path aligned with and spaced from the first said path, said paths intersecting at a point spaced from said stack, means for periodically transporting said successive pieces of material along said second path with the leading piece of material being at a position adjoining said intersecting point, said transporting and loading means being periodically actuated by said counting means for feeding said leading piece of material adjoining said intersecting point into the path of said sheets and at the precise speed of movement of and in alignment with one of said sheets for deposition onto said stack and simultaneously advancing a successive piece of material into said position and feeding another piece of material into said second path, said counting means functioning to actuate said transporting and loading means each time a predetermined number of sheets have passed said point of intersection, a cutting station having cutting means, means for feeding a web to said cutting station to cut said web into said sheets, means carried by said cutting means and coupled with said counter for counting said sheets, said counter being operable upon the attainment of a predetermined count to actuate said transporting and loading means and to automatically reset and start the next successive count, said transporting means comprises a first transporting section including conveying means carrying a plurality of sets of dogs and a second transporting section having conveying means carrying a plurality of sets of dogs, and said cutting means comprises a rotary cutter, synchronized means for driving said cutter and said transporting sections, a clutch coupling each of said transporting sections to said synchronized driving means and a brake to stop operation of each transporting section upon disengagement of the clutch, said counter being operable to effect engagement of said clutches upon completion of a predetermined count and means carried by each of said transporting sections for disengaging the associated clutch and applying said brake to precisely control the foward transport of said pieces of material, a reciprocating element synchronized with said rotary cutter and having a linear speed substantially equal to the forward speed of said sheets, a pusher dog carried by said reciprocating element and means actuated by said counter for moving said dog into engagement with the trailing edge of the leading piece of material to move it into said first path, and means including pressure rollers for gripping said piece of material and transporting it with a sheet to said stack, said pieces of material being in the form of cards forming the backs of the pads and covers forming the fronts of the pads, said loading means include spaced stations adjoining said first transporting section and spaced along the direction of motion of the first said transporting means, means for moving cards from one spaced station and covers from the other spaced station into overlying relationship with said conveying means whereby said dogs carried by the last said conveying means successively collate a card and cover and then transport the collated card and cover.

5. Apparatus according to claim 4 including vertically offset cover and card receiving guides positioned above the conveying means of said first transporting section to guide the card and cover of each set into overlying relationship.

6. Apparatus according to claim 5 wherein said counter is electrically operated, said rotary cutter pulses an electrically actuated device connected to said counter at least once during each revolution, said counter producing an electric pulse upon completion of a count, electrically operated control means for operating each of said clutches and connections between each of said control means and said counter whereby completion of a count will actuate each of said control means to effect engagement of a clutch.

7. Apparatus according to claim 6 including electrically actuated sensing devices associated with each of said transporting sections, connections between each of said devices and the control means for the associated section and sensing device actuating means carried by each of said conveying means where upon actuation of a sensor the associated control means will be operated to disengage the associated clutch and apply the brake.

* * * * *